US008141509B2

(12) United States Patent
Hoffman et al.

(10) Patent No.: US 8,141,509 B2
(45) Date of Patent: Mar. 27, 2012

(54) SUBSEA SALVAGE OPERATION USING LIFTING MAGNET

(75) Inventors: Corey Eugene Hoffman, Magnolia, TX (US); Theodore Wade Caffarel, Montgomery, TX (US)

(73) Assignee: Wild Well Control, Inc., Houston, TX (US)

( * ) Notice: Subject to any disclaimer, the term of this patent is extended or adjusted under 35 U.S.C. 154(b) by 188 days.

(21) Appl. No.: 12/271,578

(22) Filed: Nov. 14, 2008

(65) Prior Publication Data

US 2010/0122650 A1 May 20, 2010

(51) Int. Cl.
*B63C 7/00* (2006.01)

(52) U.S. Cl. ..... 114/51

(58) Field of Classification Search ..... 114/51
See application file for complete search history.

(56) References Cited

U.S. PATENT DOCUMENTS 3,009,727 A * 11/1961 Jones et al. ..... 294/65.5
3,937,163 A * 2/1976 Rosenberg ..... 114/259
4,006,527 A * 2/1977 Sivachenko ..... 30/241
4,666,357 A * 5/1987 Babbi ..... 414/138.4
6,269,763 B1 * 8/2001 Woodland ..... 114/382
6,805,056 B1 * 10/2004 Poe ..... 102/307

OTHER PUBLICATIONS

Avallone et al.—Excerpts from Marks' Standard Handbook for Mechanical Engineers, Tenth Edition, published by McGraw Hill, Copyright 1996, pp. 10-11 and 15-64.

DIMET-M—"Lifting electromagnets for underwater works series", DIMET-M online production catalogue http://www.dimetm.ru/en/catalogue/electromagnets/?_tr_id=299, date unknown, 2 pages.

* cited by examiner

*Primary Examiner* — Stephen Avila
(74) *Attorney, Agent, or Firm* — Patterson & Sheridan, L.L.P.

(57) ABSTRACT

Embodiments of the present invention generally relate to a subsea salvage operation using a lifting magnet. In one embodiment, a method of salvaging a submerged production platform includes deploying a salvage vessel to a wreckage site of the submerged production platform; lowering a lifting magnet from the salvage vessel to the submerged production platform; and activating the lifting magnet, thereby capturing at least a portion of the submerged production platform.

7 Claims, 7 Drawing Sheets

SUBSEA SALVAGE OPERATION USING LIFTING MAGNET

BACKGROUND OF THE INVENTION

1. Field of the Invention

Embodiments of the present invention generally relate to a subsea salvage operation using a lifting magnet.

2. Description of the Related Art

FIG. 1A is a cross section of a prior art sub-sea wellbore 5 drilled and completed with a land-type completion 1. A conductor casing string 10 may be set from above sea-level 15, through the sea 20, and into the sea-floor or mudline 25. The conductor casing 10 allows the wellhead (not shown) to be located on a production platform 30 above sea-level 15 rather than on the sea-floor 25. Alternatively, the platform 30 may service a subsea-type completion or a manifold from multiple subsea-type completions.

Once the conductor casing 10 has been set and cemented 35 into the wellbore 5, the wellbore 5 may be drilled to a deeper depth. A second string of casing, known as surface casing 40, may then be run-in and cemented 45 into place. As the wellbore 5 approaches a hydrocarbon-bearing formation 50, i.e., crude oil and/or natural gas, a third string of casing, known as production casing 55, may be run-into the wellbore 5 and cemented 60 into place. Thereafter, the production casing 55 may be perforated 65 to permit the fluid hydrocarbons 70 to flow into the interior of the casing. The hydrocarbons 70 may be transported from the production zone 50 of the wellbore 5 through a production tubing string 75 run into the wellbore 5. An annulus 80 defined between the production casing 55 and the production tubing 75 may be isolated from the producing formation 50 with a packer 85.

Additionally, a stove or drive pipe may be jetted, driven, or drilled in before the conductor casing 10 and/or one or more intermediate casing strings may be run-in and cemented between the surface 40 and production 55 casing strings. The stove or drive pipe may or may not be cemented.

FIG. 1B is a cross section of the platform 30 and completion 1 damaged by a hurricane. Hurricanes in the Gulf of Mexico have recently damaged or destroyed several production platforms 30 along with the completions 1. The production platforms and the completions 1 have sunk to the seafloor 25.

FIG. 2 illustrates a prior art salvage operation in progress. A diver may be dispatched from a salvage vessel (not shown) to the wreckage. A remotely operated vehicle (ROV) (not shown) may be deployed instead of or in addition to the diver. The diver and/or ROV may cut the platform wreckage into manageable pieces 30*p*. The diver and/or ROV may also assist in flooding the wellbore 5 with seawater or other kill fluid and cut the casing assembly 1 at or near the mudline 25. The diver and/or ROV may then connect a piece 30*p* of the wreckage to a line from a crane on the salvage vessel. The connected piece may then be raised to the surface 15 and loaded on a barge (not shown) or other scrap vessel. Alternatively, the piece 30*p* may be moved to a debris pile on the sea-floor 25. The process may be repeated for the wreckage pieces 30*p* and the severed casing assembly 1. Once the larger pieces have been loaded on the barge, a basket (not shown) may be lowered to the diver. The diver may then proceed to pick up smaller remaining debris off of the seafloor 25 and load the debris in the basket. The basket may then be raised and dumped on the barge. The prior art operation is time-consuming, cumbersome, and may expose the diver or other salvage equipment to unnecessary risk.

SUMMARY OF THE INVENTION

Embodiments of the present invention generally relate to a subsea salvage operation using a lifting magnet. In one embodiment, a method of salvaging a submerged production platform includes deploying a salvage vessel to a wreckage site of the submerged production platform; lowering a lifting magnet from the salvage vessel to the submerged production platform; and activating the lifting magnet, thereby capturing at least a portion of the submerged production platform.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
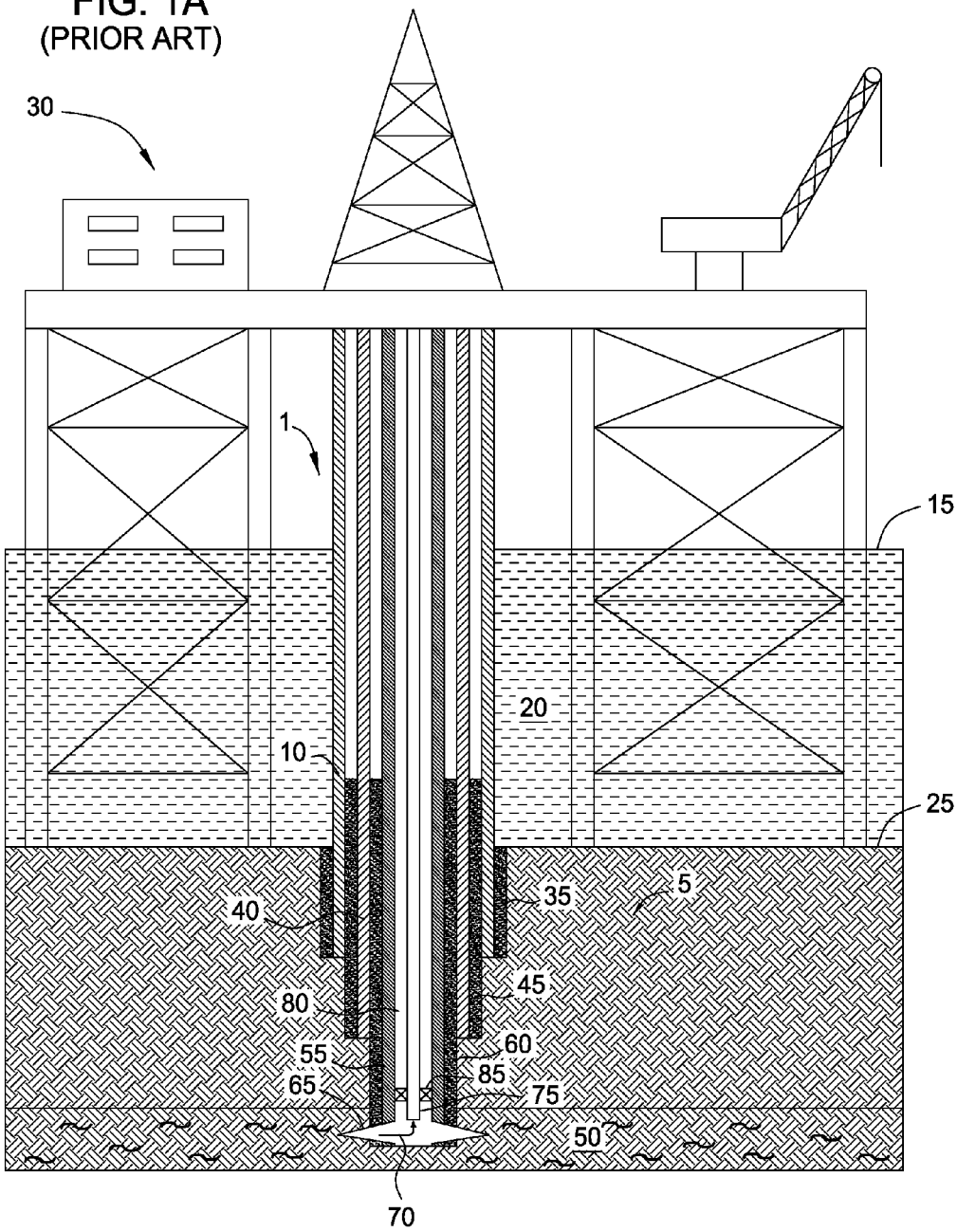
FIG. 1A (PRIOR ART)
FIG. 1A is a cross section of a prior art sub-sea wellbore 5 drilled and completed with a land-type completion 1.
Figure 1B:
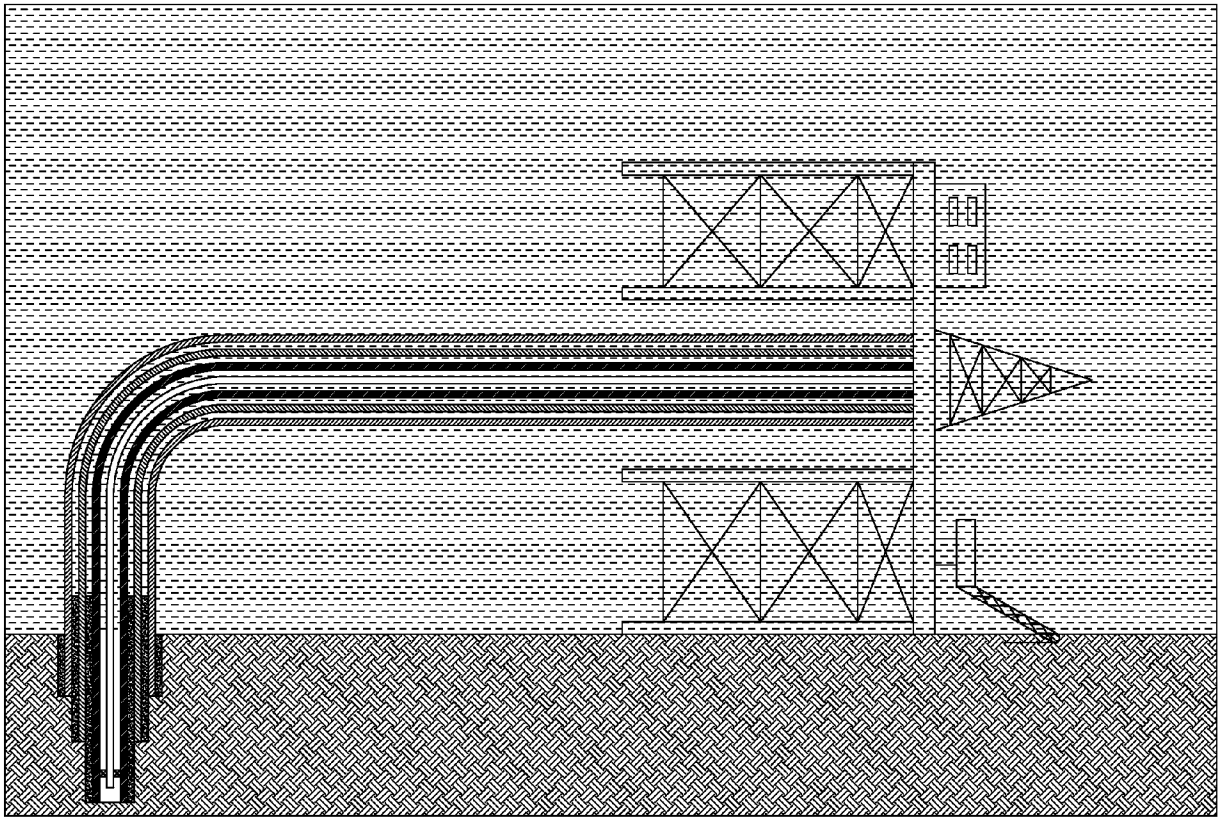
FIG. 1B (PRIOR ART)
FIG. 1B is a cross section of the platform 30 and completion 1 damaged by a hurricane.
Figure 2:
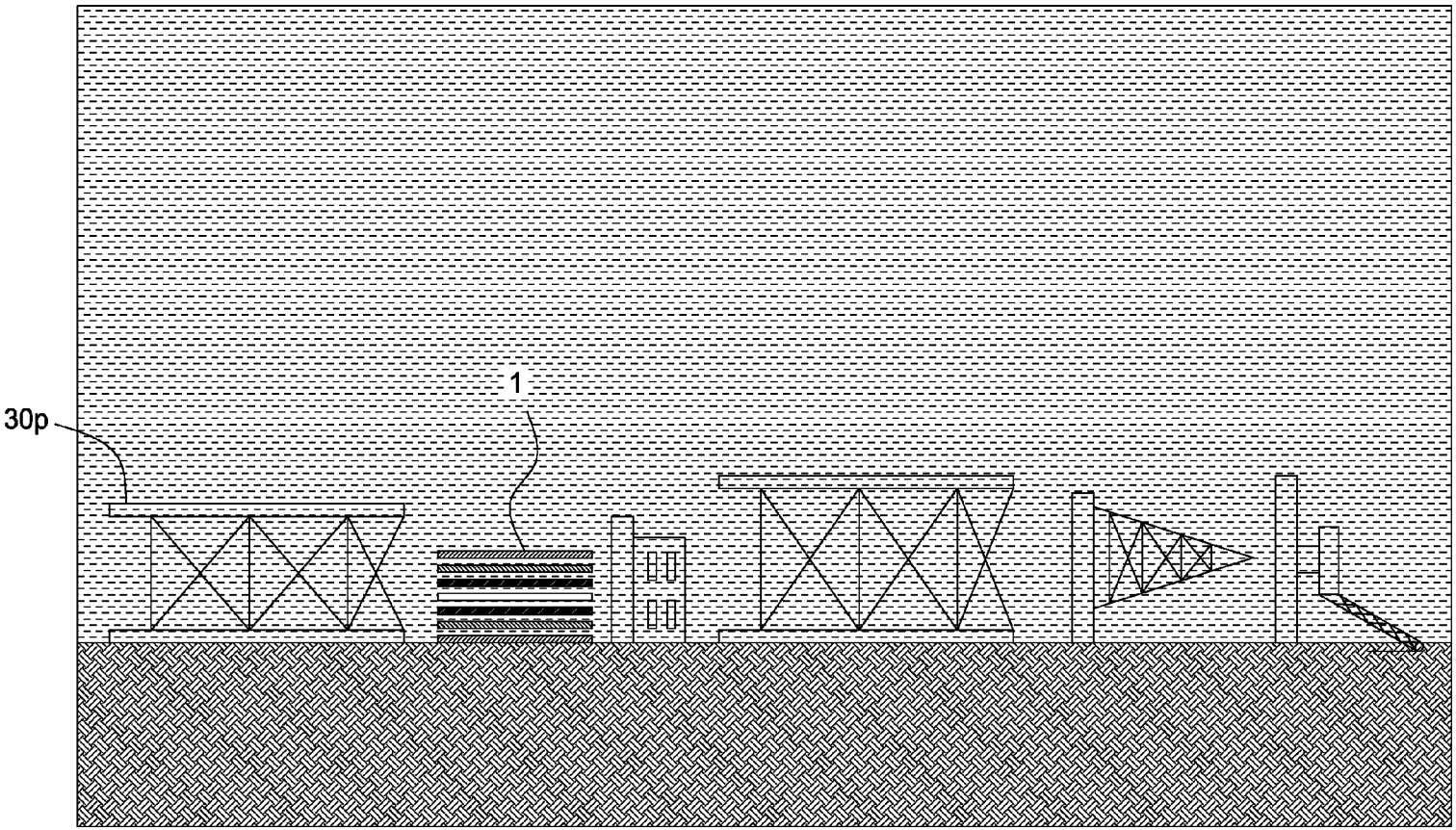
FIG. 2 (PRIOR ART)
FIG. 2 illustrates a prior art salvage operation in progress.
Figure 3:
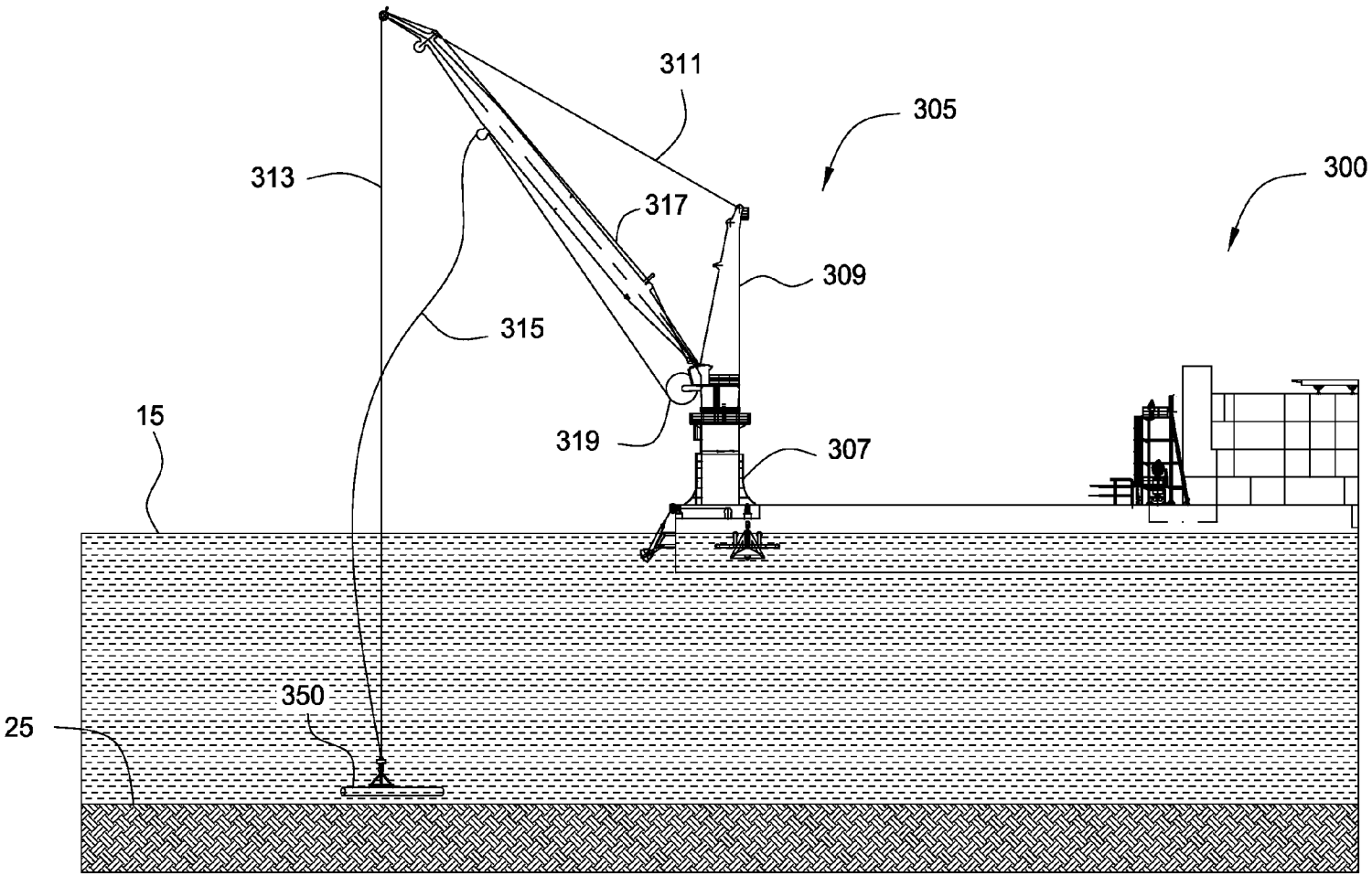
FIG. 3 illustrates a salvage vessel deploying a lifting magnet, according one another embodiment of the present invention.

FIG. 3 illustrates a salvage vessel 300 deploying a lifting magnet 350, according one another embodiment of the present invention. The salvage vessel 300 may support a crane 305. The crane 305 may include a swivel 307, a mast 309, a guy line 311, a load line 313, an electric cable 315, a boom 317, a cable reel 319, and a lifting magnet 350. The swivel 307 may support the mast 309 from a hull of the vessel 300 so that the mast may rotate relative to the hull. A motor (not shown), such as an electric or hydraulic motor, may rotate the mast 309. The boom 317 may be pivoted to the mast 309 so that the boom may be hoisted relative to the mast 309 by winding or unwinding the guy line 311 to/from from a boom winch (not shown), such as an electric or hydraulic winch, mounted on the mast 309. Alternatively, the boom may be hoisted by a piston and cylinder assembly. The load line 313 may extend from a load winch (not shown) mounted on the boom 317 or mast 309 through a sheave or pulley disposed at a distal end of the boom. The electric cable 315 may extend from a direct current (DC) power supply, such as a rectifier, wind around the reel 319 and through a sheave or pulley on the boom 317. The load line 313 may be connected to a sling 370 of the lifting magnet 350 and the electric line 315 may be connected to a terminal of the lifting magnet. The crane 305 may also include a load sensor to provide the crane operator with an indication of a weight of the load hoisted by the magnet 350.

Figure 3A:
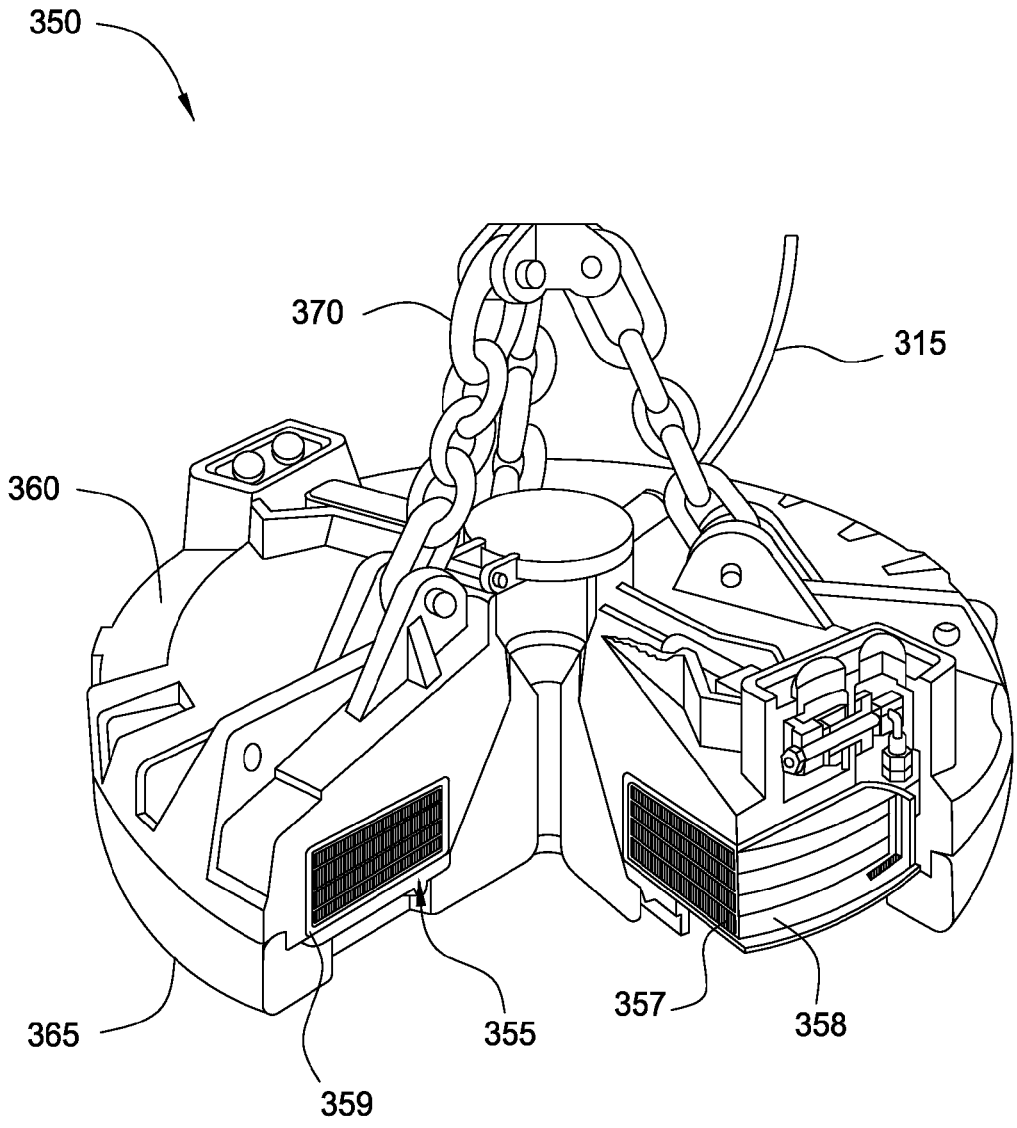
FIG. 3A is a detailed view of the lifting magnet.

FIG. 3A is a detailed view of the lifting magnet 350. The lifting magnet 350 may include a winding 355, a case 360, a bottom 365, and the sling 370. The case 360 may be round and made from a metal or alloy, such as steel. The case 360 may have an annular cavity formed therein for receiving the winding 355. The winding 355 may include two or more layers 358 vertically stacked. Each layer 358 may include wire or strap 357 wound into a spiral and made of conductive material, such as aluminum, copper, aluminum alloy, or copper alloy. Each turn of the spiral may be electrically isolated by electrical insulation, such as tape, or the conductive material may instead be anodized. Each layer 358 of the winding 355 may be isolated by electrical insulation and an outer surface of the winding 355 may be isolated from the case by electrical insulation 359. The bottom 365 may be welded to the case 360, thereby making the cavity watertight. The bottom may be round plate and made from a non-magnetic material, such as a metal or alloy, such as manganese-steel. The terminal connection to the electrical wire 315 may be watertight. Alternatively, a rectangular magnet may be used instead of the circular magnet 350. Additionally, the lifting magnet 350 may include one or more permanent magnets.

A magnet controller (not shown) may be disposed on the salvage vessel in electrical communication with the power supply. The magnet controller may include a switch for activating and deactivating the magnet and regulate electricity supplied from the power supply to ensure optimum performance of the magnet. The magnet controller may also reverse the current in the magnet 350 in order to release a scrap load. The controller may also regulate discharge of stored energy from the magnet 350. The controller may also track the service time of the magnet 350 in order to warn the operator of potential overheating of the magnet 350.

Figure 4:
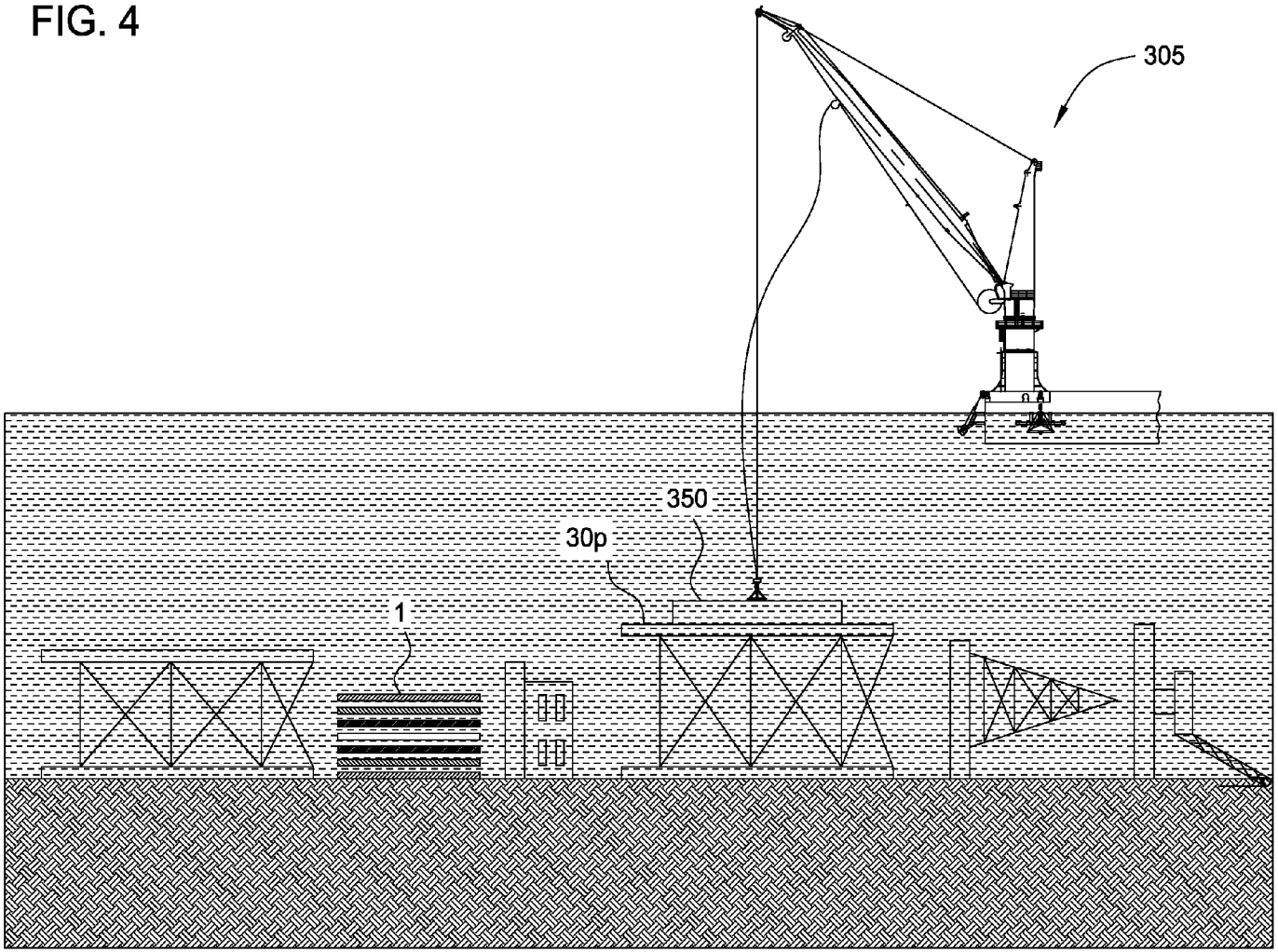
FIGS. 4 and 5 illustrate a salvage operation conducted with the salvage vessel of FIG. 3, according to another embodiment of the present invention.
Figure 5:
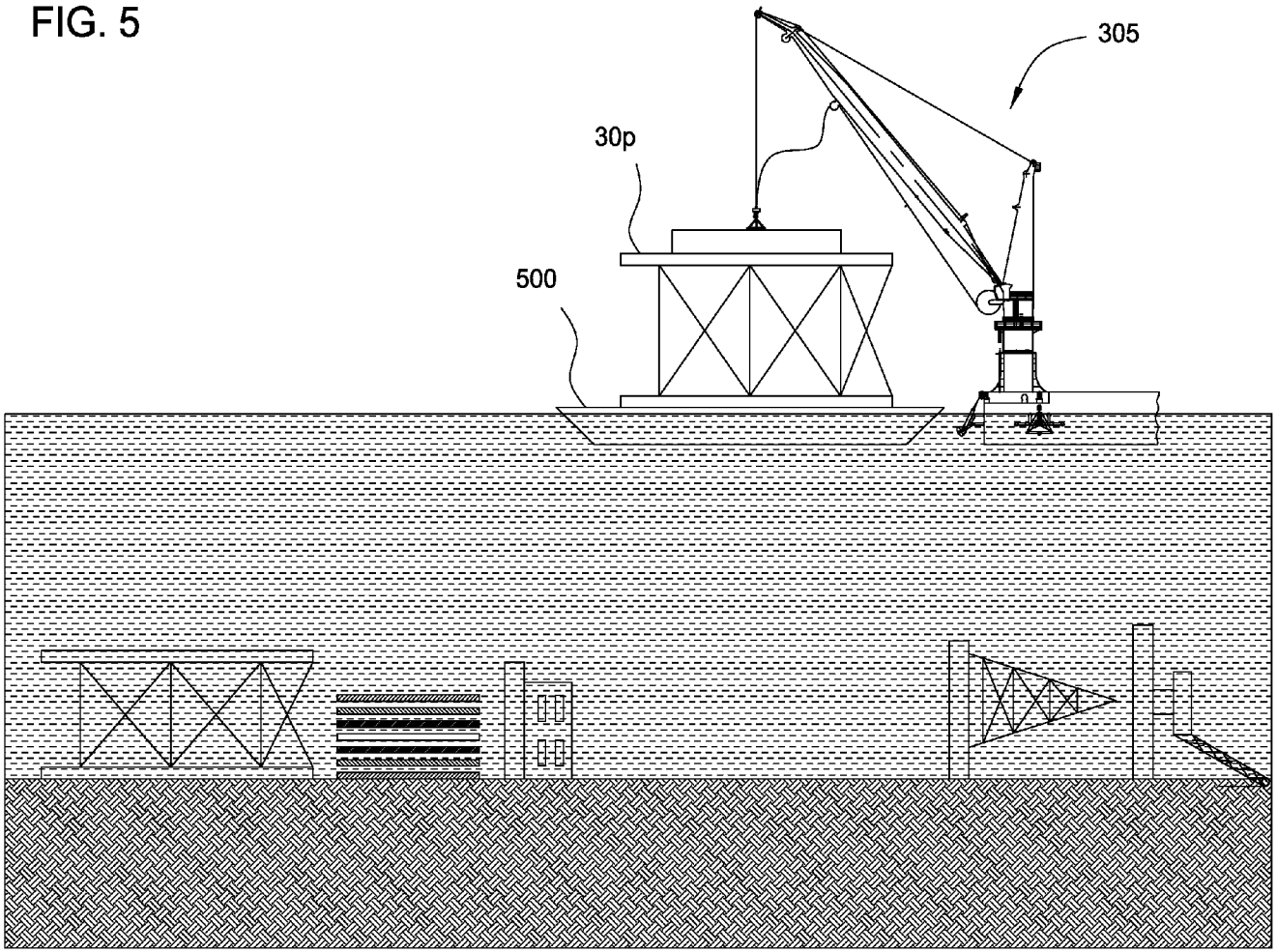

FIGS. 4 and 5 illustrate a salvage operation conducted with the salvage vessel 300, according to another embodiment of the present invention. The salvage vessel 300 may be deployed to the wreckage site. A diver may be dispatched from the salvage vessel 300 to the submerged platform 30. A remotely operated vehicle (ROV) (not shown) may be deployed instead of or in addition to the diver. The diver and/or ROV may cut the platform 30 into manageable pieces 30*p*. The diver and/or ROV may also assist in flooding the wellbore 5 with seawater or other kill fluid and cut the casing assembly 1 at or near the mudline 25. The diver and/or ROV may then return to the salvage vessel 300. Returning the diver and/or ROV to the vessel 300 before deployment of the magnet 350 into the water to capture the pieces 30*p* reduces risk to the diver and/or ROV of the pieces 30*p* shifting during hoisting of the pieces 30*p*.

Alternatively, the diver and/or ROV may remain in the water and in communication with the crane operator while the magnet 350 is hoisting the pieces 30*p*. Alternatively, an acoustic transponder, such as a beacon, may be disposed on the the load line 313, the magnet 350, or the cable 315 and the salvage vessel may include a hydrophone for receiving an acoustic signal from the beacon, thereby tracking the location of the magnet relative to the submerged platform 30. Alternatively, a subsea camera may be deployed from the salvage vessel to provide the crane operator visual guidance for positioning the magnet 350.

The lifting magnet 350 may then be deployed to the submerged platform 30 from the salvage vessel 300 using the crane 305. The magnet 350 may be activated and swept across the wreckage site until the magnet has captured a load of one or more pieces 30*p*, the casing assembly 1, and/or other debris. The magnet 350 may then be raised to the surface 15 and the load 30*p* may be positioned over a barge 500. The load 30*p* may then be released on to the barge 500 or other scrap vessel by deactivating the magnet 350. The process may be repeated until no more pieces 30*p*, casing assembly 1, and/or debris are collected by the magnet 350. The barge 500 may then be towed to a salvage yard for recycling and/or disposal of the pieces 30*p*, casing assembly 1, and/or debris. Additional barges may be used if needed. The diver/ROV may be redeployed to check for and recover any non-magnetic debris.

The downtime of the magnet 350 from releasing the load 30*p* on to the barge 500 to re-deployment of the magnet to the wreckage may be used as cooling time for the magnet Using the magnet 350 to hoist the pieces 30*p* eliminates the cumbersome process of the diver and/or ROV having to secure the load line 315 to each piece 30*p*. Further, the magnet 350 may also capture smaller debris that would otherwise require the diver and/or ROV to find, pick up, and place in the basket, require recovery by a subsequent trawling operation, or be left behind.

Alternatively, the salvage operation may be conducted on a platform servicing a subsea-type completion or a manifold from multiple subsea-type completions.

While the foregoing is directed to embodiments of the present invention, other and further embodiments of the invention may be devised without departing from the basic scope thereof, and the scope thereof is determined by the claims that follow.

The invention claimed is:

1. A method of salvaging a submerged production platform, comprising:
   - deploying a salvage vessel to a wreckage site of the submerged production platform;
   - dispatching a diver or remotely operated vehicle (ROV) from the salvage vessel to the submerged production platform;
   - cutting the submerged production platform into manageable pieces by the diver or ROV;
   - lowering a lifting electromagnet from the salvage vessel to the submerged production platform using a crane of the salvage vessel, wherein the lifting electromagnet comprises:
     - a case having a cavity formed therein,
     - a winding made from a conductive material and disposed in the cavity,
     - a bottom made from a non-magnetic material and welded to the case, thereby making the cavity watertight, and
     - a watertight terminal connector for receiving an electric cable;
   - activating the lifting electromagnet, thereby capturing one or more of the manageable pieces; and
   - raising the captured pieces to a surface of the sea using the crane.

2. The method of claim 1, further comprising cutting a casing assembly at or near a floor of the sea by the diver or ROV.

3. The method of claim 1, further comprising:
   - positioning the captured pieces over a scrap vessel using the crane; and
   - deactivating the lifting electromagnet, thereby releasing the captured pieces on to the scrap vessel.

4. The method of claim 1, further comprising deploying a subsea camera from the salvage vessel to the submerged production platform, wherein an operator of the lifting electromagnet is in visual communication with the camera.

5. The method of claim 1, further comprising tracking a location of the lifting electromagnet relative to the submerged platform using an acoustic signal.

6. The method of claim 1, further comprising repeating the lowering, activating, and raising, steps until the wreckage site is free of magnetic debris.

7. The method of claim 2, further comprising repeating the lowering, activating, and raising steps for the cut portion of the casing assembly.

* * * * *